US007690640B2

(12) United States Patent
Koga et al.

(10) Patent No.: US 7,690,640 B2
(45) Date of Patent: Apr. 6, 2010

(54) FEEDER AND PRINTER

(75) Inventors: Yuji Koga, Nagoya (JP); Daisuke Kozaki, Nagoya (JP); Yusaku Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 472 days.

(21) Appl. No.: 11/625,290

(22) Filed: Jan. 20, 2007

(65) Prior Publication Data

US 2007/0170643 A1 Jul. 26, 2007

(30) Foreign Application Priority Data

Jan. 24, 2006 (JP) ..... 2006-015414

(51) Int. Cl.
*B65H 3/44* (2006.01)

(52) U.S. Cl. ..... 271/9.13; 271/9.01; 271/9.07; 271/9.11

(58) Field of Classification Search ..... 271/9.01, 271/9.07, 9.09, 9.11, 9.13
See application file for complete search history.

(56) References Cited

U.S. PATENT DOCUMENTS 4,009,957 A * 3/1977 Suzuki et al. ..... 399/195
4,303,235 A * 12/1981 Calabrese ..... 271/162
4,416,559 A 11/1983 Steinhilber
4,789,258 A * 12/1988 Gomoll et al. ..... 400/605
5,044,621 A * 9/1991 Sachs et al. ..... 271/11
5,052,670 A * 10/1991 Makiura et al. ..... 271/9.13
5,201,873 A 4/1993 Kikuchi et al.
5,209,465 A 5/1993 Sayama et al.
5,581,289 A * 12/1996 Firl et al. ..... 347/104
5,743,519 A 4/1998 Chang et al.
6,375,183 B1 4/2002 Inoue et al.

(Continued)

FOREIGN PATENT DOCUMENTS

DE 2941816 A1 5/1981

(Continued)

OTHER PUBLICATIONS

European Patent Office, European Search Report for Related Application No. EP 07250278, dated Apr. 12, 2007.

(Continued)

*Primary Examiner*—Patrick H Mackey
*Assistant Examiner*—Howard Sanders
(74) *Attorney, Agent, or Firm*—Baker Botts L.L.P.

(57) ABSTRACT

This invention is related to a feeder for transporting a print medium from a tray along a U-shaped transporting path. The feeder comprises a transporting guide. The transportation guide comprises an outer transporting guide and an inner transporting guide, the U-shaped transporting path is formed between the outer transporting guide and the inner transporting guide. The outer transporting guide extends from a position adjacent to one end of the first tray. The inner transporting guide extends from a position adjacent to one end of the second tray. The inner transporting guide comprises a concave portion facing the outer transporting guide. The concave portion has a length which extends from an upstream end to a predetermined position of the inner transporting guide along a transportation direction of the second print medium, and a width which is adjusted such that the second print medium is capable of passing within the concave portion.

22 Claims, 8 Drawing Sheets

U.S. PATENT DOCUMENTS

| | | | |
|---|---|---|---|
| 6,659,444 | B2 | 12/2003 | Kawarama |
| 7,303,189 | B2 | 12/2007 | Huang et al. |
| 2005/0196216 | A1 | 9/2005 | Tanahashi et al. |
| 2005/0275150 | A1 | 12/2005 | Cook et al. |
| 2007/0158896 | A1 | 7/2007 | Koga et al. |
| 2007/0170636 | A1 | 7/2007 | Kozaki et al. |

FOREIGN PATENT DOCUMENTS

| | | | | |
|---|---|---|---|---|
| EP | 1219554 | A1 | | 7/2002 |
| EP | 1570997 | A1 | | 9/2005 |
| JP | S59-151175 | A | | 8/1984 |
| JP | S62-191361 | A | | 8/1987 |
| JP | H01-162446 | U | | 11/1989 |
| JP | H03-025446 | U | | 3/1991 |
| JP | H06-191704 | A | | 7/1994 |
| JP | H08-208051 | A | | 8/1996 |
| JP | H10-114444 | A | | 5/1998 |
| JP | 2002019993 | A | * | 1/2002 |
| JP | 2002154716 | A | * | 5/2002 |
| JP | 2002240979 | A | * | 8/2002 |
| JP | 2002356247 | A | * | 12/2002 |
| JP | 2005-101685 | A | | 4/2005 |
| JP | 2005-247544 | A | | 9/2005 |

OTHER PUBLICATIONS

Japanese Patent Office, Office Action in Related Application No. 2006-01514 dated Jul. 8, 2008.

European Patent Office, European Search Report for European Patent Application No. 07250292.5 (counterpart to the co-pending U.S. Appl. No. 11/625,291), dated May 9, 2007.

Japan Patent Office, Notice of Reasons for Rejection for Japanese Patent Application No. 2006-015413 (counterpart to the co-pending U.S. Appl. No. 11/625,291), mailed Jul. 8, 2008.

United States Patent and Trademark Office, Office Action for the co-pending U.S. Appl. No. 11/625,291, dated Jul. 11, 2008.

United States Patent and Trademark Office, Office Action for the co-pending U.S. Appl. No. 11/625,291, dated Jan. 7, 2009.

United States Patent and Trademark Office, Final Office Action for the co-pending U.S. Appl. No. 11/625,291, dated Jun. 15, 2009.

* cited by examiner

FEEDER AND PRINTER

CROSS REFERENCE TO RELATED APPLICATION

This application claims priority to Japanese Patent Application No. 2006-015414 filed on Jan. 24, 2006, the contents of which are hereby incorporated by reference into the present application.

BACKGROUND OF THE INVENTION

1. Field of the Invention

This invention is related to a feeder and a printer.

2. Description of the Related Art

Feeders for transporting print media along a U-shaped transporting path from a plurality of trays are already disclosed in the art. A feeder comprises, for example, a first tray capable of housing a first print medium, a second tray capable of housing a second print medium, and a transporting guide that guides the first print medium and the second print medium from each tray to a downstream end of the U-shaped transporting path. The first print medium is A4 or B5 normal size paper, glossy paper, or thick paper. The second print medium is a postcard or photograph size that is smaller than the first print medium. The first tray and second tray are stacked one above the other, and the second tray is located between the first tray and the downstream end of the U-shaped transporting path. Japanese Laid-open Patent Publication No. 10-114444 describes a feeder comprising feeding rollers corresponding to top and bottom trays respectively, and U-shaped transporting paths corresponding to the top and bottom trays respectively.

BRIEF SUMMARY OF THE INVENTION

In the feeder detailed in Japanese Laid-open Patent Publication No. 10-114444, providing the feeding rollers corresponding to the top and bottom trays respectively and the U-shaped transporting paths corresponding to the top and bottom trays respectively leads to problems in which the configuration of the feeder becomes complex, and that the size of the feeder increases.

The above problems can be dealt with by having a section of the U-shaped transporting path be a common part. For example, the U-shaped transporting path that has been made into a common part comprises an outer transporting guide and an inner transporting guide. The outer transporting guide extends from a position adjacent to one end of the first tray that is at the bottom side, and the inner transporting guide extends from a position adjacent to one end of the second tray that is at the top side. It is possible to utilize the part extending from the first tray and the part extending from the second tray such that they are a common part. This is an effective method for minimizing the problems of increase complexity and size.

However, when a section of the U-shaped transporting path is made into a common part, problems can occur at an upstream end of the U-shaped transporting path. For example, a case can be considered where the U-shaped transporting path is bent to a curvature factor whereby the print medium housed in the first tray can be transported smoothly. In this case, since the second tray is situated between the first tray and the downstream end of the U-shaped transporting path, there is an increase in the curvature factor of the inlet part where the second print medium is fed to the U-shaped transporting path. When the second print medium is transported with a state of great curvature at the inlet part, the rebound force thereof turns into resistance during transportation. It thus becomes difficult to stably transport the print medium when a section of the U-shaped transporting path is made into a common part.

This type of problem can occur when print media are sent along a common U-shaped transporting path from any of two or more stacked trays. Furthermore, in a case where miniaturization of the feeder is desired, the curvature factor can easily become great at the inlet part, where the print medium housed in the tray enters the U-shaped transporting path. The aforementioned problems are manifested to a great degree when miniaturization of the feeder is desired.

The technique described in the present specification aims to solve the aforementioned problems, and details a feeder wherein print media housed in two or more stacked trays can be transported stably.

In the technique described in the present specification, an inner transporting guide is characterized by comprising a concave portion facing the outer transporting guide. The concave portion has a length which extends from an upstream end to a predetermined position on the inner transporting guide along the transportation direction of the second print medium, and a width which is adjusted such that the second print medium is capable of passing within the concave portion.

The concave portion can provide a transporting path with a small curvature factor at the inlet part, where the second print medium enters the U-shaped transporting path. Since the second print medium consequently passes along the path in the concave portion which has a small curvature factor, the second print medium is fed from the second tray with a small curvature factor. As a result, there is a reduction in the rebound force created by the reduction of the curvature factor of the second print medium, and it is possible to transport the second print medium stably. Furthermore, since the concave portion is only formed in a section of the inner transporting guide, it is possible to provide a transporting path wherein the outer transporting guide and the inner transporting guide, excluding the concave portion, are capable of stably transporting the first print medium housed in the first tray.

That is, by forming the concave portion in only a section of the inner transporting guide, it is possible to transport both the first print medium and the second print medium stably.

DETAILED DESCRIPTION OF THE INVENTION

Figure 1:
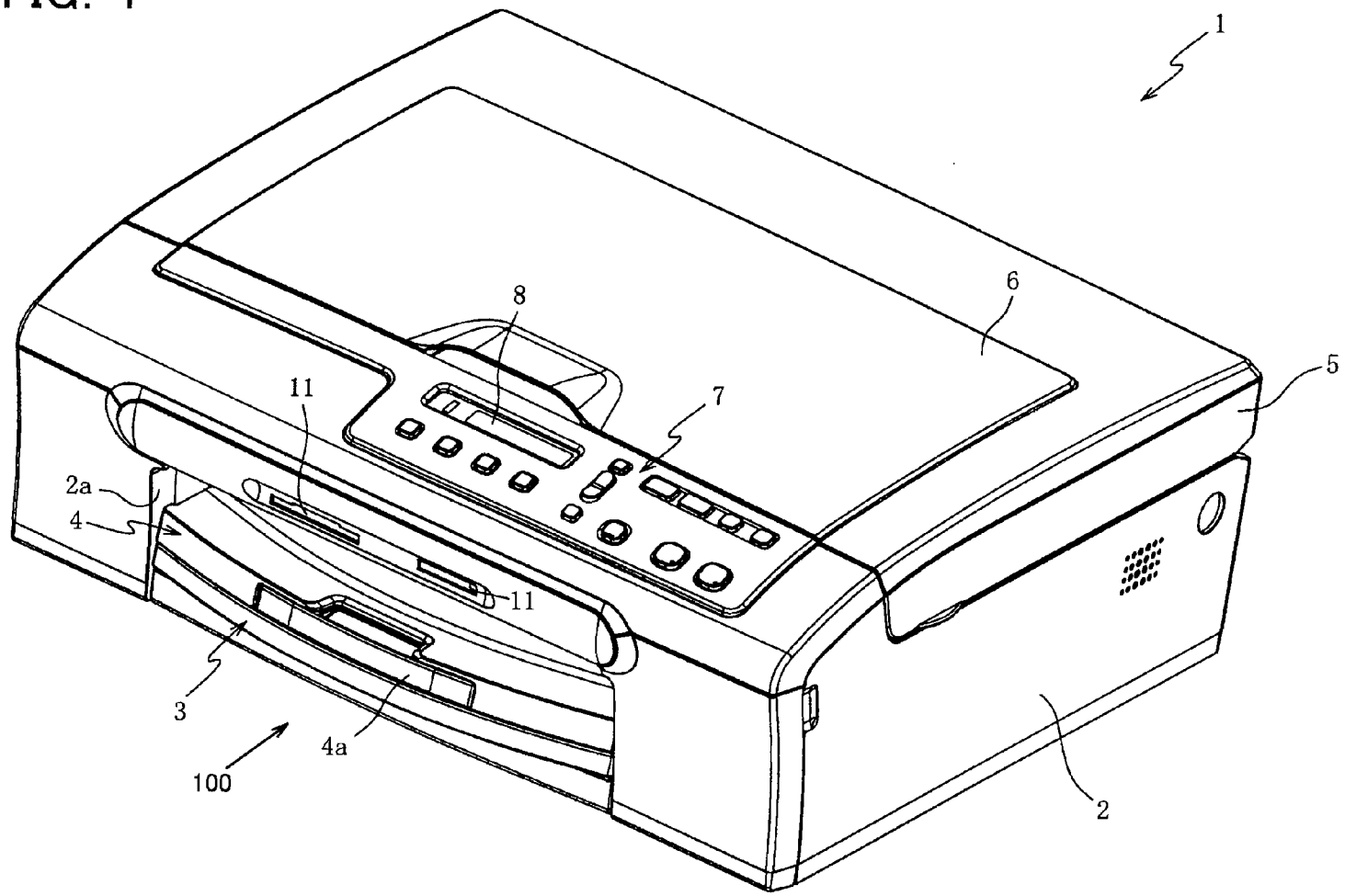
FIG. 1 shows a perspective view of a multi-function peripheral device in which a feeder of the present invention has been mounted.

A preferred embodiment of the present invention will be described below with reference to the figures. FIG. 1 shows a perspective view of a multi-functional peripheral device 1 in which a feeder of the present invention is mounted. The multi-functional peripheral device 1 is provided with various functions such as a fax function, a printer function, a scanner function, a copy function, a video printer function, etc.

As shown in FIG. 1, the multi-functional peripheral device 1 comprises a housing 2 and an image reading device 5 for reading documents. An opening 2*a* is formed at a front side (a proximate side in FIG. 1) of the housing 2. A lower feeder tray 3 and a top feeder tray 4 are inserted into the opening 2*a* along the direction shown by the arrow 100. A first print medium can be housed in a stacked state in the lower feeder tray 3. A second print medium can be housed in a stacked state in the top feeder tray 4. The first print medium is A4 or B5 normal size paper, glossy paper, or thick paper. The second print medium is postcard or photograph size paper that is smaller than the first print medium. The width and length of the second print medium is smaller than the width and length of the first print medium.

An ink jet head printing device (to be described) is located within the multi-functional peripheral device 1. The first print medium and the second print medium housed in the lower feeder tray 3 and the top feeder tray 4 are transported to the ink jet head printing device utilizing a feeder (to be described). The ink jet head printing device prints an image onto the print medium that has been transported. The print medium that has had the image printed thereon is ejected to the top feeder tray 4.

That is, the top feeder tray 4 also functions as a paper discharge stand for holding the print medium that has had the image printed thereon. As a result, the top feeder tray 4 is provided with a stopper 4*a* for preventing the print medium that has had the image printed thereon from falling down from the top feeder tray 4. The stopper 4*a* is located such that it can be pulled out in the direction reverse to the arrow 100.

The image reading device 5 is located on the housing 2. The image reading device 5 is coupled to the housing 2 by a hinge (not shown). The image reading device 5 is capable of rotating with the hinge as the center, and can be opened or closed with respect to the housing 2. The image reading device 5 comprises a glass plate formed on an upper face thereof and on which documents are mounted, a document reading scanner (for example, a CIS: Contact Image Sensor) that is located below the glass plate, and a document cover body 6 for covering the glass plate. The cover body 6 is coupled to the image reading device 5 by a hinge (not shown). The cover body 6 is capable of rotating with the hinge as the center, and can be opened or closed in an up-down direction with respect to the glass plate. The document is placed on the glass plate, and the image thereof is read by the document reading scanner moving back and forth in a predetermined scanning direction. Once the image has been read it can be printed onto the print medium, or transmitted utilizing the fax function.

The following are located on a top surface of the housing 2: an operation panel 7 that comprises operation buttons, and a liquid crystal display 8 for displaying an operation sequence or the state of a process currently being executed. The operation buttons include a start button and a stop button. The liquid crystal display 8 displays, as required, a setting state for the multi-functional peripheral device 1, various operation messages, etc.

Further, an external memory inserting portion 11 into which an external memory can be inserted is located at a front surface of the housing 2. The following, for example, can be utilized as the external memory: a CompactFlash (registered trademark), Smart Media (registered trademark), Memory Stick (registered trademark), SD card (registered trademark), xD card (registered trademark). When the external memory has been inserted into the external memory inserting portion 11, data stored in the external memory is read into an internal memory of the multi-function peripheral device 1. The data that has been read in can be printed onto the print medium by the ink jet head printing device.

Figure 2:
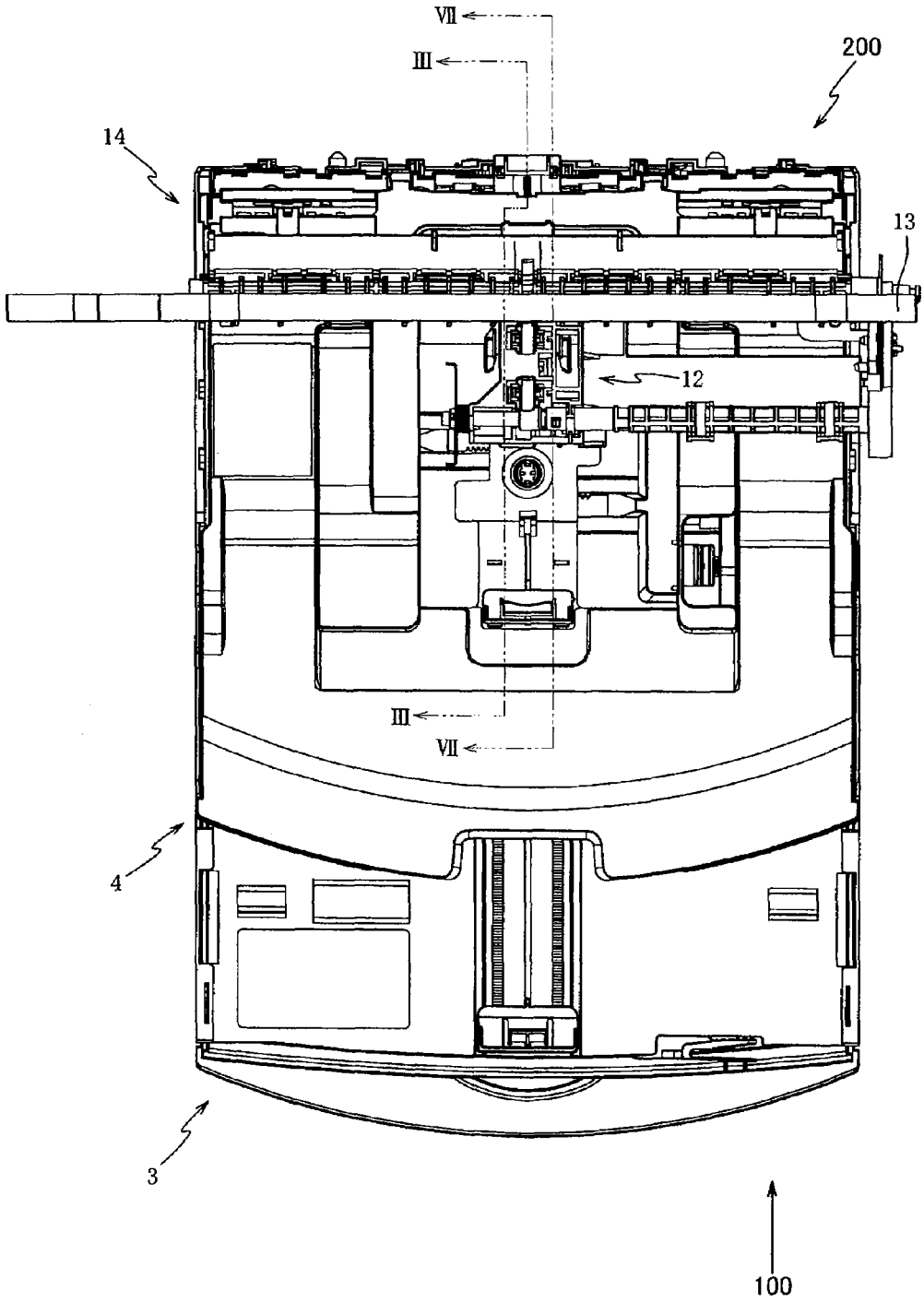
FIG. 2 shows a plan view of the feeder.
Figure 3:
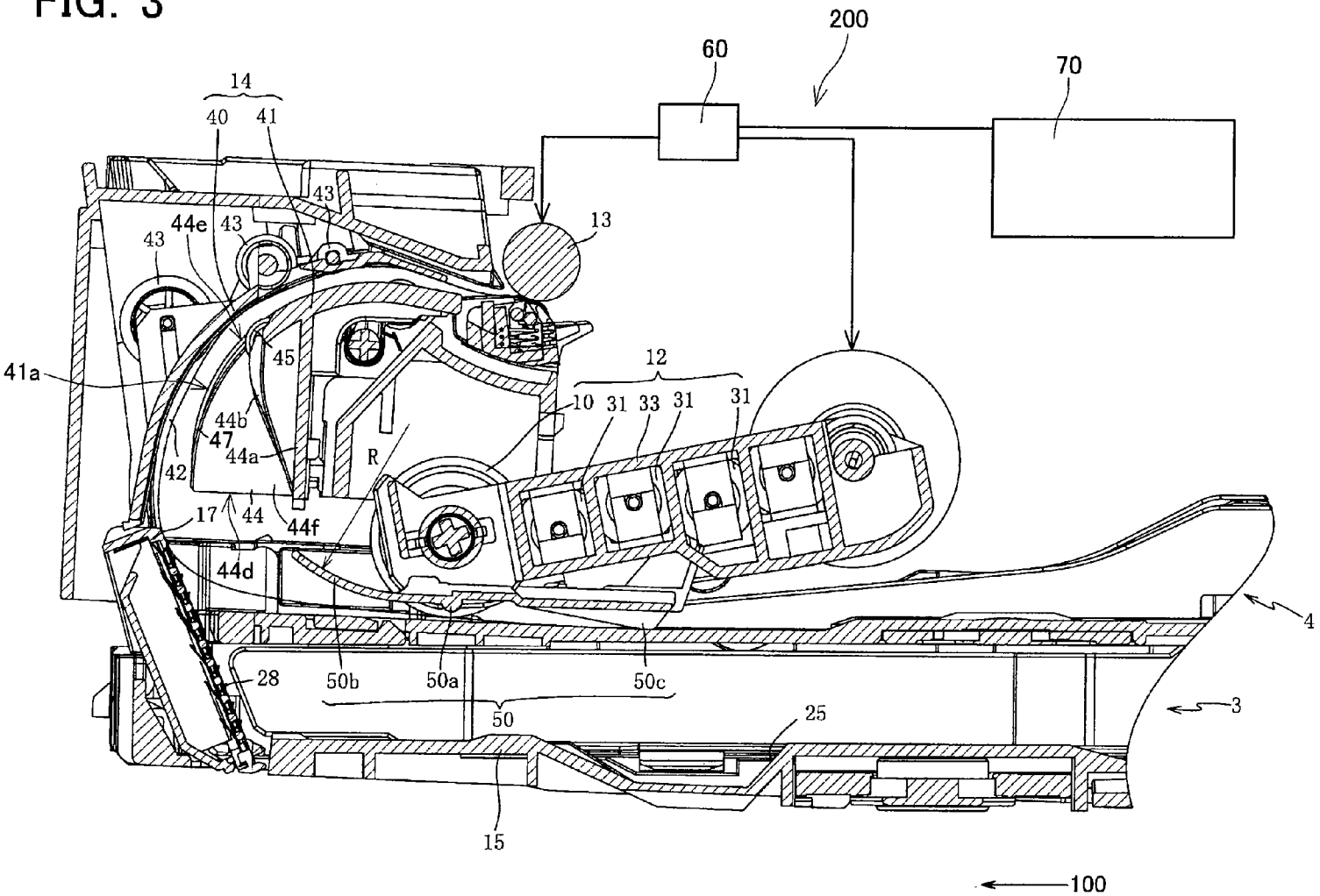
FIG. 3 shows a cross-sectional view of the feeder along the line III-III shown in FIG. 2.

Next, the feeder 200 of the present invention will be described with reference to FIGS. 2 and 3. FIG. 2 shows a plan view of the feeder 200. FIG. 3 shows a cross-sectional view of the feeder 200 along the line III-III shown in FIG. 2. As shown in FIG. 3, the feeder 200 comprises the lower feeder tray 3, the top feeder tray 4, a feeding roller 10 located above the top feeder tray 4, a transportation guide 14 that forms a U-shaped transporting path, a transporting roller 13 located at a downstream end of the U-shaped transporting path, a controller 60 that controls the transporting roller 13 and the feeding roller 10, and a movement member 50 that moves the feeding roller 10 upwards. The controller 60 controls the transporting roller 13 and the feeding roller 10 such that the peripheral velocity of the transporting roller 13 is greater than the peripheral velocity of the feeding roller 10. Alternatively, the controller 60 controls the transporting roller 13 and the feeding roller 10 such that the driving of the feeding roller 10 is halted when the print medium has reached the transporting roller 13. Alternatively, the controller 60 controls the transporting roller 13 and the feeding roller 10 such that the feeding roller 10 rotates in reverse when the print medium has reached the transporting roller 13. When the controller 60 controls the transporting roller 13 and the feeding roller 10 in the manners described above, tension is generated in the print medium moving through the transporting path, and bending of the print medium can thus be prevented.

Utilizing a feeding mechanism 12 (to be described), the feeding roller 10 is capable of selectively making contact with the first print medium housed in the lower feeder tray 3 or the second print medium housed in the top feeder tray 4, and selectively feeding the first print medium or the second print medium to the transporting path. The print medium that has been selected is transported by the transportation guide 14 while being bent into a U-shaped state, and is transported by the transporting roller 13 to a downstream side of the transporting roller 13. An ink jet head printing device 70 connected with the controller 60 is located at the downstream side of the transporting roller 13. The ink jet head printing device 70 prints an image onto the print medium that has been transported by the feeder 200.

Figure 4:
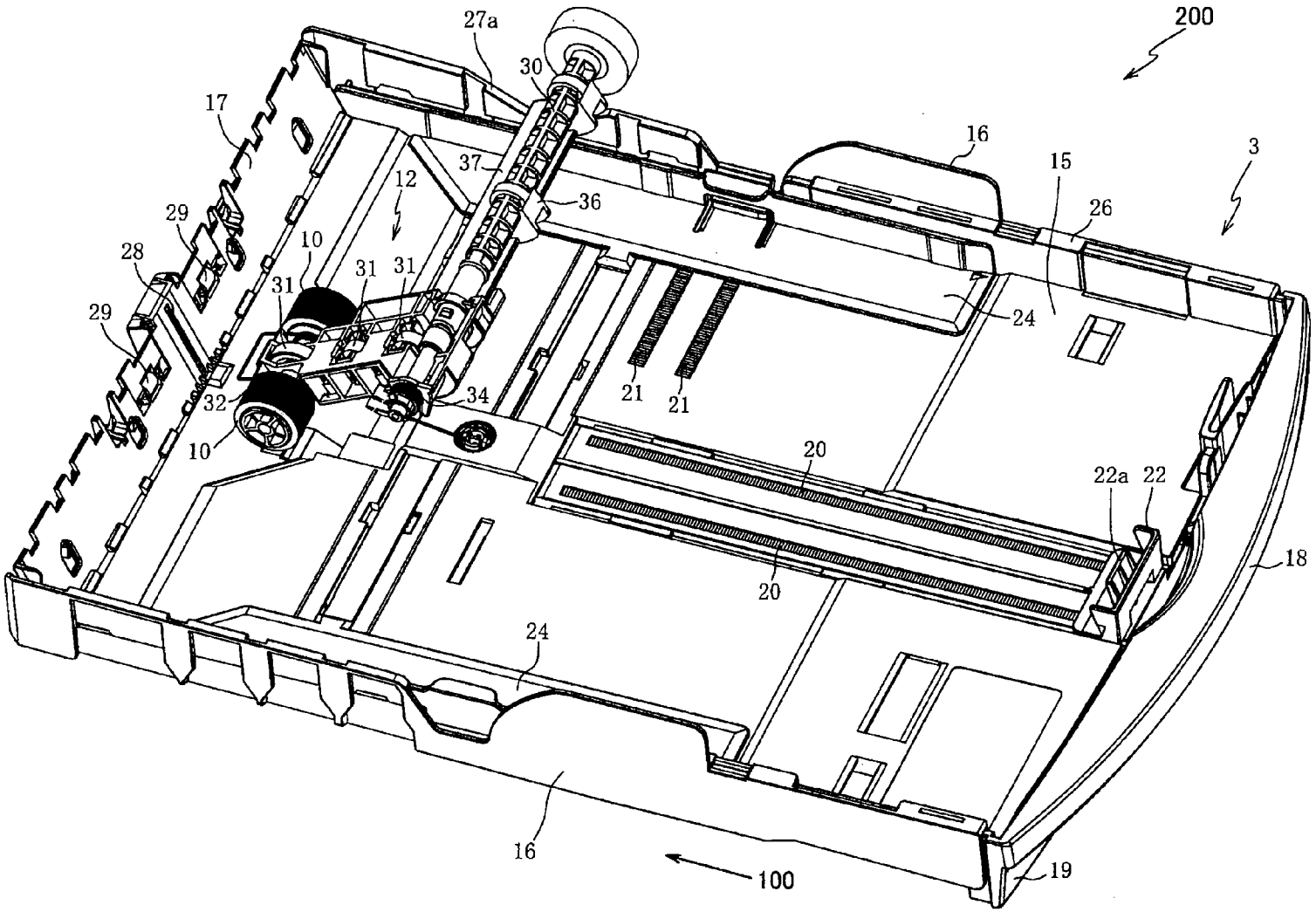
FIG. 4 shows a perspective view of a lower feeder tray.

Next, the configuration of the feeder 200 will be described in detail. First, the lower feeder tray 3 will be described with reference to FIG. 4. FIG. 4 shows a perspective view of the lower feeder tray 3. The lower feeder tray 3 houses the first print medium in a stacked state. The first print medium is, for example, A4 or B5 normal size paper, etc., glossy paper, or thick paper. The first print medium is housed with the short edges thereof extending in a direction orthogonal to the transportation direction.

The lower feeder tray 3 is substantially box-shaped with a top surface thereof being open. The lower feeder tray 3 comprises a supporting wall 15, a pair of side walls 16 located at side edges of the supporting wall 15, an oblique separating wall 17 located at a rear end (the left side in FIG. 4), and a front wall 19 located at a front end (the right side in FIG. 4). A handle portion 18 is formed at the front wall 19. The lower feeder tray 3 has a housing space within which the first print medium is housed. The housing space is surrounded by the supporting wall 15, the pair of side walls 16, the oblique separating wall 17, and the front wall 19.

A first pair of guide grooves 20 and second pair of guide grooves 21 are formed in the supporting wall 15 of the lower feeder tray 3. The first pair of guide grooves 20 extends along the direction of the arrow 100, and the second pair of guide grooves 21 extends along a direction orthogonal to the direction of the arrow 100. A first adjusting body 22 is provided that is capable of moving along the first pair of guide grooves 20. The first adjusting body 22 has an oblique surface 22*a* that is substantially parallel to the oblique separating wall 17 (to be described). The first adjusting body 22 can be moved to a rear end of the first print medium placed upon the supporting wall 15. When the first adjusting body 22 has been moved to the rear end of the first print medium, the oblique surface 22*a* of the first adjusting body 22 makes contact with the rear end of the first print medium. The first print medium is thus held, in the direction of the arrow 100, by the oblique separating wall 17 and the oblique surface 22*a* of the first adjusting body 22. The first print medium is consequently held stably, in the direction of the arrow 100, within the lower feeder tray 3.

The first of the pair of second adjusting bodies 24 provided is capable of moving along the second guide grooves 21. In cross-section, the second adjusting body 24 is formed in an L-shape. The pair of second adjusting bodies 24 is configured such that when the first of the second adjusting bodies 24 is moved along the second guide grooves 21, the other of the second adjusting bodies 24 moves the same distance toward the first second adjusting body 24. When the first second adjusting body 24 is moved toward a first side edge of the first print medium placed upon the supporting wall 15, the second adjusting body 24 also moves toward the other side edge of the first print medium. The first print medium is consequently held stably, in the direction orthogonal to the arrow 100, by the pair of second adjusting bodies 24 within the lower feeder tray 3.

As shown in FIG. 3, a concave portion 25 is formed in the supporting wall 15 of the lower feeder tray 3. The concave portion 25 is configured such that a second portion 50*c* of the movement member 50 (to be described) can enter therein. When the first print medium has been completely discharged out of the lower feeder tray 3, the second portion 50*c* of the movement member 50 enters the concave portion 25, and an inner surface of the concave portion 25 makes contact with the second portion 50*c* of the movement member 50. The feeding roller 10 is consequently lifted up from the supporting wall 15 of the lower feeder tray 3. A space is thus formed between the feeding roller 10 and the supporting wall 15 of the lower feeder tray 3, and the feeding roller 10 consequently idles. It is thus possible to prevent abrasion of the feeding roller 10 caused by the feeding roller 10 making contact with the supporting wall 15 of the lower feeder tray 3.

As shown in FIG. 4, a support member 26 is formed at a top surface of each of the pair of side walls 16 of the lower feeder tray 3. The support members 26 are the parts that make contact with an inner surface of supporting walls of the top feeder tray 4. The lower feeder tray 3 and the top feeder tray 4 are stacked in a manner such that they are capable of sliding due to the support members 26.

Furthermore, a cam portion 27*a* is formed in the first of the side walls 16. A cam follower member 37 of the feeding mechanism 12 (to be described) makes contact with the cam portion 27*a*. The cam follower member 37 is coupled to a driving shaft 30 of the feeding mechanism 12, and is capable of rotating with the driving shaft 30 as the center. The cam follower member 37 is located between the cam portion 27*a* and the driving shaft 30, and supports the driving shaft 30. When the lower feeder tray 3 is attached or removed, a feeding arm 33 rotates with the driving shaft 30 as the center, and the feeding roller 10 that is being supported at one end of the feeding arm 33 is moved upward or downward.

The oblique separating wall 17 of the lower feeder tray 3 separates the print media into single sheets. The oblique separating wall 17 is inclined in the transportation direction, and is formed from polyoxymethylene (POM). Polyoxymethylene (POM) has a smaller coefficient of friction than other resin materials. As a result, the print medium can be transported smoothly one sheet at a time after the uppermost end of the stack of print medium makes contact with the oblique separating wall 17. The other parts comprising the lower feeder tray 3 are formed from acrylonitrile butadiene styrene (ABS). The oblique separating wall 17 is consequently made separately from the other parts. The following are located on a surface face of the oblique separating wall 17: a plate spring separating pad 28 located at a central position in the widthwise direction of the oblique separating wall 17, and rotating rollers 29, which rotate freely and are located to the left and right of the separating pad 28. The separating pad 28 and the rotating rollers 29 transport the print medium one sheet at a time from the uppermost end of the stack of print medium.

Figure 5:
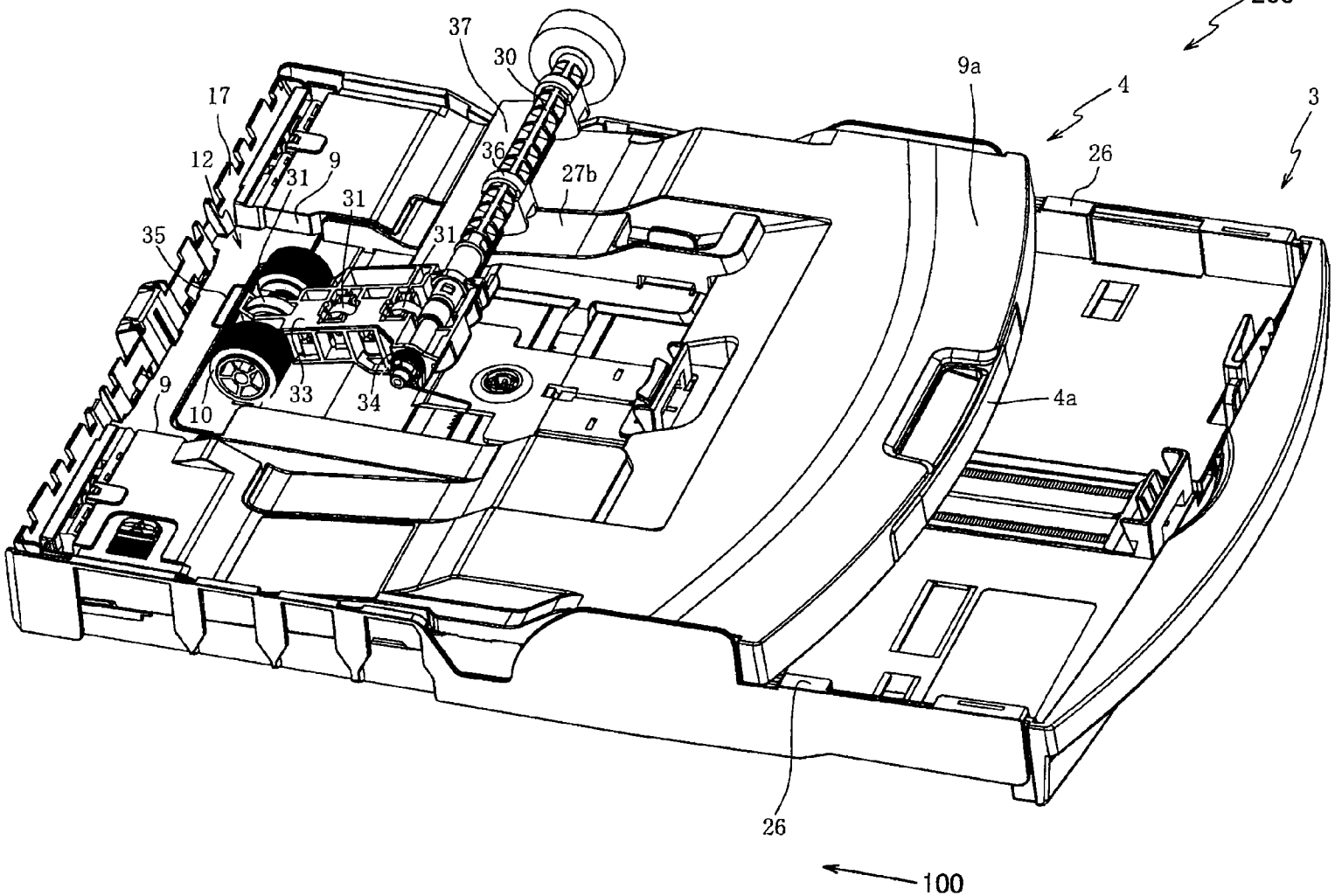
FIG. 5 shows a perspective view of a top feeder tray stacked on the lower feeder tray.

Next, the top feeder tray 4 will be described with reference to FIG. 5. FIG. 5 shows a perspective view of the top feeder tray 4 stacked on the lower feeder tray 3. The top feeder tray 4 is formed in a plate shape with a predetermined thickness. The top feeder tray 4 is supported on the support members 26 of the lower feeder tray 3, and is stacked above the lower feeder tray 3. The top feeder tray 4 is capable of sliding with respect to the lower feeder tray 3 (in the direction of the arrow 100 and in the direction opposite thereto). In the case where the second print medium housed in the top feeder tray 4 is to be used, the top feeder tray 4 is pushed inward (in the direction of the arrow 100) to a determined position. In the case where the second print medium is not to be used, the top feeder tray 4 is pulled outward (in the opposite direction to the arrow 100), and the top feeder tray 4 is removed from the determined position.

The top feeder tray 4 comprises a housing groove 9 formed in a position that includes an edge portion of an inner side of the top feeder tray 4 (the left side in FIG. 5). The housing groove 9 has a predetermined width and length. The second print medium is housed, in a stacked state, in the housing groove 9. The width of the housing groove 9 (in the direction orthogonal to the direction of the arrow 100) is smaller than the width of the first print medium housed in the lower feeder tray 3. That is, the first print medium, which has a larger size, is housed in the lower feeder tray 3, and the second print medium, which has a smaller size, is housed in the top feeder tray 4. The second print medium is a postcard or photograph that is smaller in size than the first print medium.

From a plan view, the center of the housing groove 9 in the widthwise direction (the direction orthogonal to the direction of the arrow 100) is identical to the center of the lower feeder tray 3 in the widthwise direction. As a result, the central position in the widthwise direction of the first print medium housed in the lower feeder tray 3 is identical to the central position in the widthwise direction of the second print medium housed in the top feeder tray 4. The first print medium and the second print medium can consequently be transported stably by the one feeding roller 10.

The top feeder tray 4 comprises a top surface part 9*a* that is located at an outward side (the right side in FIG. 5) with respect to the housing groove 9. The top surface part 9*a* functions as a part upon which the print medium that has been printed is disposed. In other words, a section of the paper discharge tray of the top feeder tray 4 has a grooved portion formed therein that functions as a feeder tray.

A cam portion 27*b* is formed in a first side portion of the housing groove 9. The cam follower member 37 makes contact with the cam portion 27*b*. The cam follower member 37 is located between the cam portion 27*b* and the driving shaft 30, and supports the driving shaft 30. When the top feeder tray 4 is attached or removed, the feeding arm 33 rotates with the driving shaft 30 as the center, and the feeding roller 10 that is being supported at one end of the feeding arm 33 is moved upward or downward.

Next, the feeding mechanism 12 will be described with reference to FIG. 5. The feeding mechanism 12 comprises the driving shaft 30, the feeding arm 33 supported by the driving shaft 30, a plurality of gear transmission mechanisms 31 located within the feeding arm 33, and the feeding roller 10 that is supported rotatably at one end of the feeding arm 33.

The driving shaft 30 is formed from synthetic resin, and is supported rotatably in a shaft hole (not shown). The driving shaft 30 extends above the top feeder tray 4 from a side toward a central portion thereof.

The feeding arm 33 is formed from synthetic resin and covers the plurality of gear transmission mechanisms 31. The feeding arm 33 is supported in a manner such that it is capable of rotating with the driving shaft 30 as the center, and moves the feeding roller 10 between the lower feeder tray 3 and the top feeder tray 4.

The gear transmission mechanisms 31 are aligned along the direction of the arrow 100. The plurality of gear transmission mechanisms 31 transmit the rotating driving force of the driving shaft 30 to the feeding roller 10, causing the feeding roller 10 to rotate.

The feeding roller 10 is capable of making contact selectively with the first print medium housed in the lower feeder tray 3 and the second print medium housed in the top feeder tray 4, and is capable of selectively feeding the first print medium or the second print medium into the transporting path.

The feeding mechanism 12 further comprises a lower feeder tray coiled spring 34 and a top feeder tray coiled spring 35. The lower feeder tray coiled spring 34 is wound in a direction such that the feeding arm 33 can support the driving shaft 30. The top feeder tray coiled spring 35 is wound in a direction such that the feeding arm 33 can support the feeding roller 10.

Figure 7:
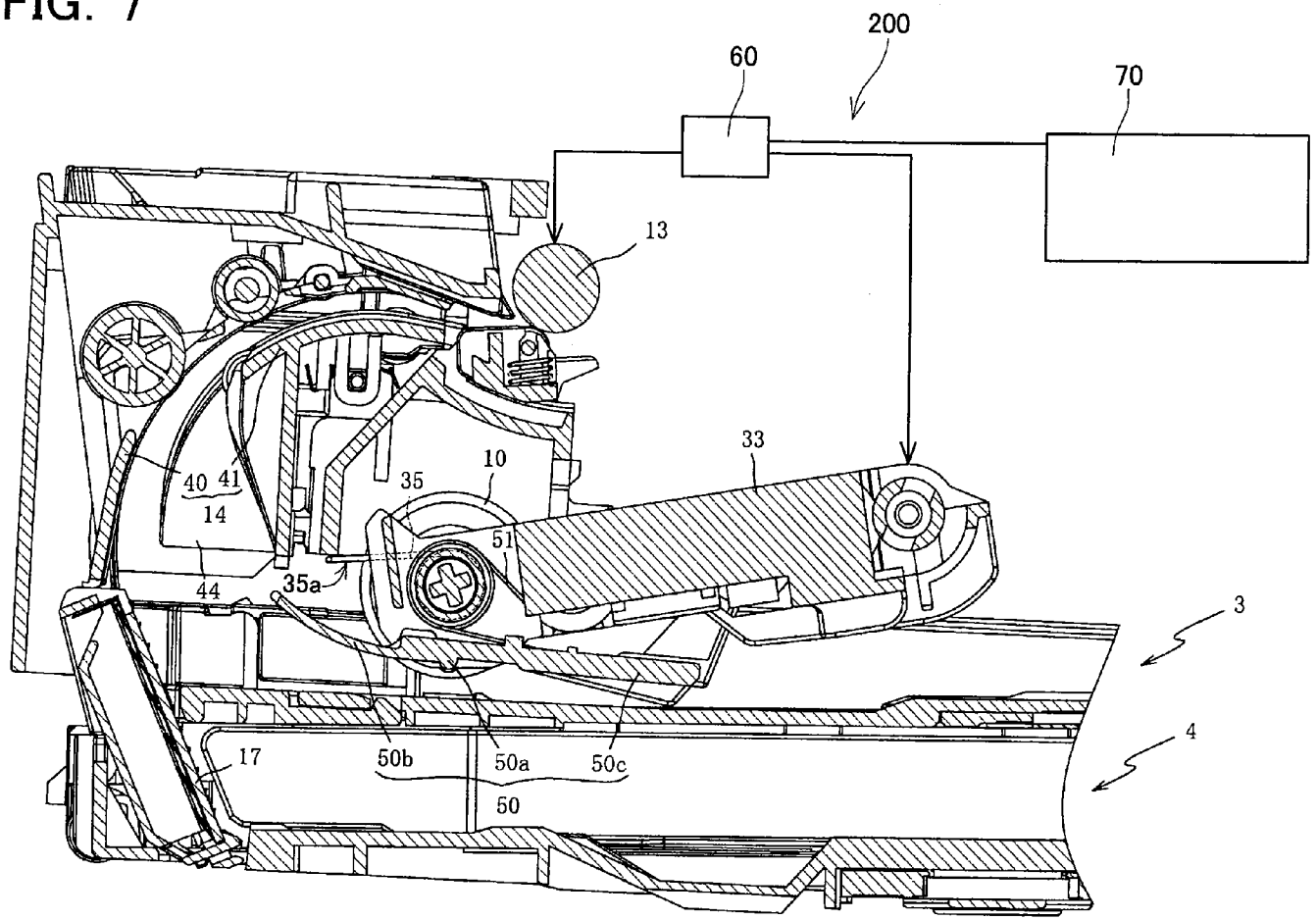
FIG. 7 shows a cross-sectional view of the feeder along the line VII-VII shown in FIG. 2.

The lower feeder tray coiled spring 34 biases the feeding arm 33 downward thereby to push the feeding roller 10 downward. A first pushing force generated by the lower feeder tray coiled spring 34 is exerted on the feeding roller 10 such that the feeding roller 10 pushes the first print medium housed in the lower feeder tray 3. A second pushing force generated by the top feeder tray coiled spring 35 is exerted on the second print medium housed in the top feeder tray 4. As shown in FIG. 7, one end 35*a* of the top feeder tray coiled spring 35 is capable of making contact with a part of the housing 2. When the end 35*a* of the top feeder tray coiled spring 35 makes contact with the part of the housing 2, the top feeder tray coiled spring 35 biases the feeding roller 10 downward. That is, the top feeder tray coiled spring 35 pushes the feeding roller 10 downward when the feeding roller 10 is situated above the top feeder tray 4. The second pushing force generated by the top feeder tray coiled spring 35 is greater than the first pushing force generated by the lower feeder tray coiled spring 34. It is thus possible to reliably transport the print medium one sheet at a time by means of the feeding roller 10 pressing down on this print medium while transporting the print medium.

Since the top feeder tray 4 is stacked above the lower feeder tray 3, the angle formed by the top feeder tray 4 and the feeding arm 33 is smaller than the angle formed by the lower feeder tray 3 and the feeding arm 33. When the angle formed with the feeding arm 33 is smaller, it becomes more difficult for the feeding roller 10 to transport the print medium one sheet at a time.

In the present embodiment, however, the top feeder tray coiled spring 35 presses the second print medium with the second pushing force that is greater than the first pushing force. As a result, the feeding roller 10 is capable of reliably transporting the second print medium housed in the top feeder tray 4 one sheet at a time.

The feeding mechanism 12 further comprises the cam follower member 37 that extends below the driving shaft 30 from the feeding arm 33, and that is supported by the driving shaft 30 via a shaft support 36. The cam follower member 37 makes contact with the cam portion 27*b* of the top feeder tray 4 and the cam portion 27*a* of the lower feeder tray 3, and allows the feeding arm 33 to rotate with the driving shaft 30 as the center. The feeding roller 10 is thus able to make contact with the uppermost sheet of the print medium housed in either the lower feeder tray 3 or the top feeder tray 4.

Next, the transportation guide 14 will be described with reference to FIG. 3. The transportation guide 14 guides the print medium fed by the feeding roller 10 to the transporting roller 13. The print medium housed in the top feeder tray 4 and the lower feeder tray 3 is fed into the transporting path by the feeding roller 10. The print medium is transported in a horizontal U-shape within the transporting path, and is delivered to the transporting roller 13. The feeding roller 10 and the transporting roller 13 are configured with a positional relationship such that both are capable of simultaneously making contact with the print medium.

The transportation guide 14 comprises an outer transporting guide 40 that forms an outer peripheral surface of the transporting path, and an inner transporting guide 41 that forms an inner peripheral surface of the transporting path. The transporting path is formed between the outer transporting guide 40 and the inner transporting guide 41.

The outer transporting guide 40 extends in a curved shape from a position adjacent to the oblique separating wall 17 of the lower feeder tray 3 to a position adjacent to the transporting roller 13. From a side view, the outer transporting guide 40 is formed in a bow shape. The curvature factor of the outer transporting guide 40 is formed so as to conform to a shape for smoothly transporting the first print medium (normal paper, glossy paper, thick paper, etc.) housed in the lower feeder tray 3. A plurality of ribs 42 extending along the transportation direction are formed on an inner surface of the outer transporting guide 40. A plurality of rotating rollers 43 that rotate in the transportation direction are located near the center of the outer transporting guide 40. The rotating rollers 43 protrude into the transporting path from the inner surface of the outer transporting guide 40. The rotating rollers 43 are capable of reducing contact resistance with the print medium, and serve to guide the print medium smoothly along the transportation direction.

Figure 6:
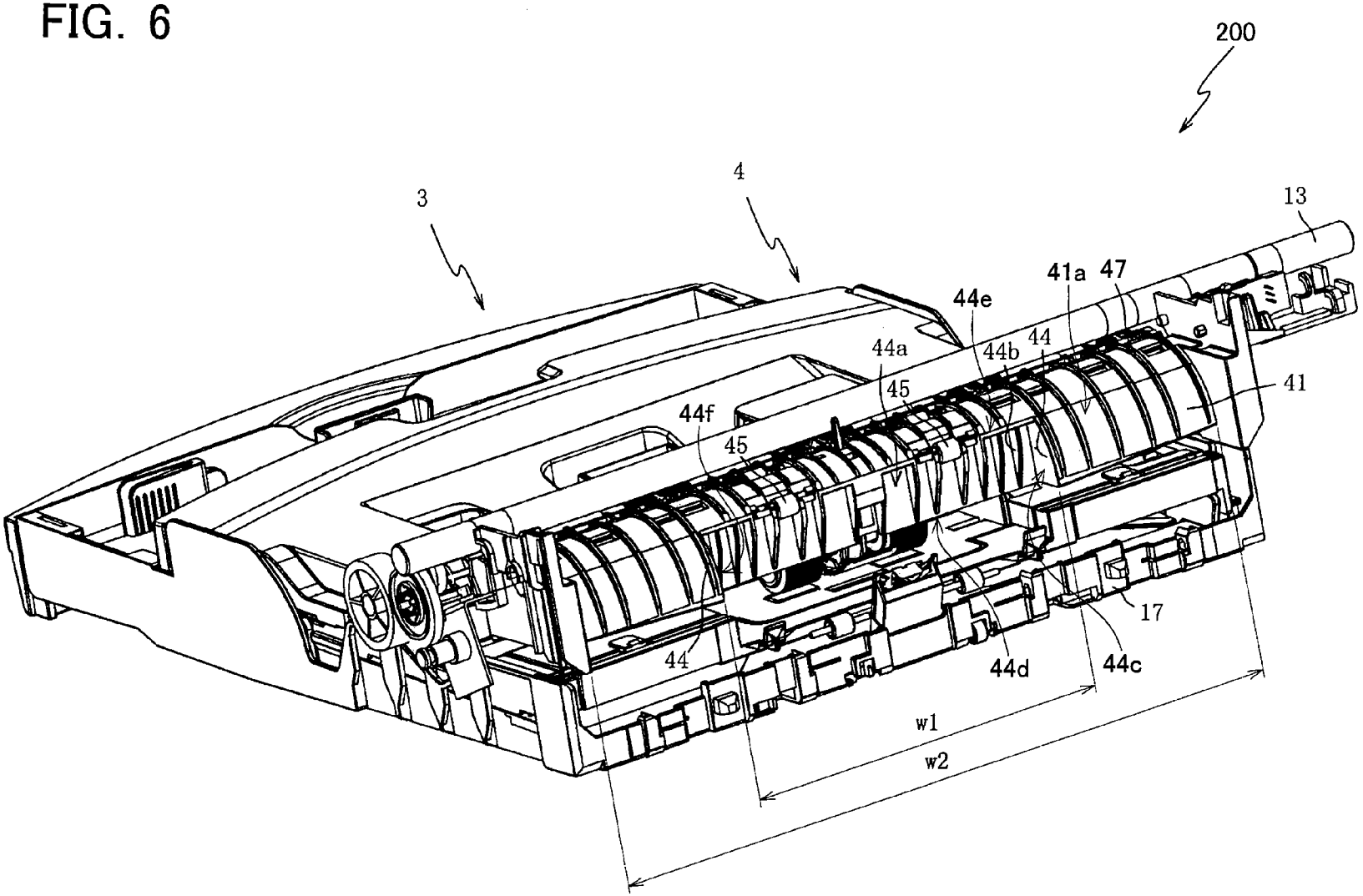
FIG. 6 shows a perspective view of an inner transporting guide.

Next, the inner transporting guide 41 will be described with reference to FIGS. 3 and 6. FIG. 6 shows a perspective view of the inner transporting guide 41. The inner transporting guide 41 extends from a position adjacent to one end of the top feeder tray 4 to a position adjacent to the transporting roller 13. From a side view, the inner transporting guide 41 is formed in a bow shape.

As shown in FIGS. 3 and 6, the inner transporting guide 41 comprises a first surface 41*a*, a second surface 44*a*, a first side surface 44*c*, and a second side surface 44*f*. The first surface 41*a* faces the outer transporting guide 40. The second surface

44*a* is located between the first side surface 44*c* and the second side surface 44*f*, and faces the outer transporting guide 40. The first side surface 44*c* and the second side surface 44*f* face one another. The second surface 44*a*, the first side surface 44*c*, and the second side surface 44*f* form a concave portion 44. The first surface 41*a* is formed surrounded by the concave portion 44.

The concave portion 44 has a length which extends along the transportation direction from an upstream end 44*d* to a predetermined position 44*e* of the inner transporting guide 41, and a width W1 that extends in a direction orthogonal to the transportation direction. The width W1 of the concave portion 44 is smaller than the width of the first print medium, and is greater than the width of the second print medium.

The concave portion 44 can form a transporting path in which the curvature factor at an inlet part, where the second print medium enters the transporting path, is small. As described above, the controller 60 controls the transporting roller 13 and the feeding roller 10. As a result, when the second print medium is transported along the transporting path and reaches the transporting roller 13, the transporting roller 13 creates a state wherein the second print medium is pulled toward the downstream side of the transporting path. Tension is thus exerted on the second print medium. Since the transporting path is formed in a U-shape, the second print medium moves within the transporting path from the outer transporting guide 40 side toward the inner transporting guide 41 side to reduce the tension in the second print medium. Since the inner transporting guide 41 has the concave portion 44 formed therein along which the second print medium can pass, the second print medium is fed along the transporting path through the concave portion 44. The second print medium can consequently be transported from the top feeder tray 4 within the concave portion 44 in a state with a small curvature factor. The rebound force of the second print medium caused by the curvature factor is thus reduced, and it is consequently possible to transport the second print medium stably.

Furthermore, the concave portion 44 is formed in only a section of the inner transporting guide 41. That is, the first surface 41*a* of the inner transporting guide 41 is formed at a side of the concave portion 44. Since the width W1 of the concave portion 44 is smaller than the width of the first print medium housed in the lower feeder tray 3, the first print medium cannot pass within the concave portion 44. The first print medium is transported along the transporting path formed between the outer transporting guide 40 and the first surface 41*a* of the inner transporting guide 41 at the side of the concave portion 44. Further, since the distance between the outer transporting guide 40 and the first surface 41*a* of the inner transporting guide 41 is substantially constant along the transportation direction, the curvature factor of the first surface 41*a* is substantially identical with the curvature factor of the outer transporting guide 40. As described above, the curvature factor of the outer transporting guide 40 is set to a preferred value for allowing the first print medium to be transported stably. As a result, the transporting path formed between the outer transporting guide 40 and the first surface 41*a* has a curvature factor that is preferred for stably transporting the first print medium. The first print medium is consequently transported stably along the transporting path formed between the outer transporting guide 40 and the first surface 41*a*. Furthermore, the plurality of ribs 47 that extend in the transportation direction are formed on the first surface 41*a*. The contact resistance between the first print medium and the first surface 41*a* is thus reduced, and the first print medium can be transported smoothly.

By forming the concave portion 44 in only a section of the inner transporting guide 41 in this feeder 200, it is possible to stably transport both the first print medium housed in the lower feeder tray 3 and the second print medium housed in the top feeder tray 4.

As shown in FIG. 6, the center of the inner transporting guide 41 is substantially identical to the center of the concave portion 44 in the widthwise direction of the inner transporting guide 41. In other words, a central axis bisecting a width W2 of the inner transporting guide 41 is identical to a central axis bisecting the width W1 of the concave portion 44.

When the central positions are identical, the first surface 41*a* of the inner transporting guide 41 has a uniform width at both sides of the concave portion 44. As a result, the transporting path formed between the first surface 41*a* and the outer transporting guide 40 can be kept uniform on both the left and right sides with respect to the concave portion 44. The transporting path formed between the first surface 41*a* and the outer transporting guide 40 can be kept uniform on both the left and right sides in spite of the concave portion 44 being provided. The first print medium housed in the lower feeder tray 3 is consequently transported in an extremely stable state.

As described above, the concave portion 44 extends from the upstream end 44*d* to the predetermined position 44*e* of the inner transporting guide 41. Further, the depth of the concave portion 44 gradually decreases along the transportation direction of the second print medium. That is, the height of the first side surface 44*c* and the second side surface 44*f* gradually decreases along the transportation direction of the second print medium. Due to this feature, there is a reduction in the curvature factor in the peripheral direction of the inner transporting guide 41 in the portion thereof where the concave portion 44 is formed. The second print medium passing through the concave portion 44 is consequently transported in a state with a small curvature factor.

Furthermore, the concave portion 44 has a plurality of ribs 44*b* formed on the second surface 44*a*. The ribs 44*b* extend along the transportation direction, and do not extend beyond the concave portion 44. As shown in FIG. 3, the height of the ribs 44*b* gradually increases along the transportation direction. The ribs 44*b* have a curved profile and are joined to the first surface 41*a* of the inner transporting guide 41 at the predetermined position 44*e*. Furthermore, rotating rollers 45 are located at the predetermined positions 44*e*. The rotating rollers 45 are located between adjacent ribs 44*b*, and are capable of rotating in the transportation direction.

The ribs 44*b* make it possible to move the second print medium housed in the top feeder tray 4 smoothly from the concave portion 44 to the transporting path formed between the outer transporting guide 40 and the first surface 41*a* of the inner transporting guide 41 at the downstream side of the transportation direction. That is, it is possible to smoothly join the transporting path formed by the concave portion 44 with the transporting path formed by the first surface 41*a* and the outer transporting guide 40. The second print medium that has passed along the concave portion 44 can consequently move smoothly into the transporting path formed from the first surface 41*a* and the outer transporting guide 40.

Next, the movement member 50 will be described with reference to FIG. 3. The movement member 50 receives a force from the second print medium being transported in the transporting path, and utilizes this force to move the feeding roller 10 upwards.

The movement member 50 is configured to be substantially plate-shaped, and comprises a first portion 50*b* located to the downstream of the feeding roller 10, a coupling portion 50*a* that is joined indirectly with the feeding roller 10 via the feeding arm 33, and a second portion 50*c* located to the upstream of the feeding roller 10. The coupling portion 50*a* is a substantially central part of the first portion 50*b* and the second portion 50*c*. The first portion 50*b* is joined with the coupling portion 50*a*, and the second portion 50*c* is also joined with the coupling portion 50*a*. The first portion 50*b* and the second portion 50*c* extend in opposing directions from the coupling portion 50*a*.

The first portion 50*b* protrudes into the transporting path. When the transporting roller 13 and the feeding roller 10 simultaneously make contact with the second print medium, the first portion 50*b* is situated in a position such that it is capable of making contact with the second print medium.

Moreover, the first portion 50*b* is formed so as to be capable of making contact with only the second print medium housed in the top feeder tray 4. Furthermore, as the first portion 50*b* does not make contact with the first print medium housed in the lower feeder tray 3, the shape and position of the first portion 50*b* can be configured so as to correspond to the second print medium housed in the top feeder tray 4. As a result, the shape and position of the first portion 50*b* can be configured so as to efficiently receive the force generated by the movement of the second print medium housed in the top feeder tray 4.

The second portion 50*c* is a part that constantly makes contact with the print medium housed in the top feeder tray 4, and is the part that is pushed downward while the first portion 50*b* is pushed upward by the second print medium.

The feeding roller 10 is supported, by the feeding arm 33, in a manner that allows the feeding roller 10 to rotate. As a result, the feeding arm 33 does not rotate even if the feeding roller 10 rotates. The movement member 50 is coupled to the feeding arm 33 in a manner that allows rotation. As a result, the feeding arm 33 does not rotate even if the movement member 50 rotates. The feeding roller 10 and the movement member 50 are coupled indirectly via the feeding arm 33.

The movement member 50 can function as a lever. In this case, the second portion 50*c* includes a section that functions as a fulcrum. The first portion 50*b* contains a part upon which the applied force from the print medium is exerted. The coupling portion 50*a* contains a part which exerts a force upon the feeding roller 10 so as to move this feeding roller 10 upward.

When the second print medium is fed by the feeding roller 10 into the transporting path, the second print medium is guided by the outer transporting guide 40 and is transported along the transporting path. When the second print medium reaches the transporting roller 13, the transporting roller 13 and the feeding roller 10 work together to transport the second print medium. As described above, in the feeder 200 the controller 60 controls the transporting roller 13 and the feeding roller 10, and consequently tension is exerted on the second print medium when the second print medium is transported simultaneously by the feeding roller 10 and the transporting roller 13. Since the transporting path is formed in a U-shape, the second print medium moves from the outer transporting guide 40 side toward the inner transporting guide 41 side to reduce the tension is the second print medium. The first portion 50*b* of the movement member 50 is positioned in a location such that it can make contact with the second print medium while the feeding roller 10 and the transporting roller 13 are simultaneously making contact with the second print medium, i.e. while the second print medium is moving from the outer transporting guide 40 side toward the inner transporting guide 41. As a result, the first portion 50*b* and the second print medium make contact with one another while the transporting roller 13 and the feeding roller 10 are simultaneously making contact with the second print medium.

When the second print medium makes contact with the first portion 50*b*, the second print medium exerts a force upon the first portion 50*b* by pushing the first portion 50*b* upward. The movement member 50 utilizes this force to move the feeding roller 10 upward.

The second portion 50*c* in the movement member moves downward when the second print medium makes contact with the first portion 50*b*, and this first portion 50*b* is moved upward. When the second portion 50*c* is moved downward to push downward the uppermost end of the stack of the second print medium housed in the top feeder tray 4, the second portion 50*c* functions as the fulcrum of the lever. As a result, the coupling portion 50*a* located between the first portion 50*b* and the second portion 50*c* is capable of utilizing the applied force that the first portion 50*b* received by interacting with the second print medium, and can push the feeding roller 10 upward. When the feeding roller 10 moves upward, the second print medium is released from between the feeding roller 10 and the top feeder tray 4 and the transporting load during transportation is thereby reduced. The movement member 50 does not utilize a driving source, but instead utilizes the force generated when the second print medium is transported. The movement member 50 is thus able to reduce the transporting load during transportation of the second print medium using a simple configuration.

The first portion 50*b* curves upward from the coupling portion 50*a* to the tip of this first portion 50*b*. When the first portion 50*b* is rotated upward, the first portion 50*b* curves along the transportation direction. As a result, the second print medium, which is moving such that its curvature factor is gradually reduced, can gradually make contact with the first portion 50*b*. Furthermore, as the first portion 50*b* is curved, the first portion 50*b* and the second print medium can make contact across a wide area. If the first portion 50*b* were not curved, the second print medium would only make contact with the tip of the first portion 50*b*. It is possible to prevent excessive force being exerted locally on the second print medium by ensuring that the first portion 50*b* and the second print medium make contact across a wide area, thus preventing damage to the second print medium.

The first portion 50*b* does not make contact with the print medium before the print medium reaches the transporting roller 13. In order to realize this, a curvature factor R of the first portion 50*b* may be set smaller than the curvature factor of the outer transporting guide 40. In other words, the curvature factor R of the first portion 50*b* may be set smaller than the curvature factor of the print medium that is curved prior to reaching the transporting roller 13. It is consequently possible to prevent the feeding roller 10 from separating from the second print medium before the second print medium is transported by the transporting roller 13.

Furthermore, since the second print medium moves from the outer transporting guide 40 side toward the inner transporting guide 41 side so that the curvature factor thereof gradually decreases, the second print medium can be effectively brought into contact with the first portion 50*b* by forming the first portion 50*b* so that it has a curvature factor smaller than the curvature factor of the outer transporting guide 40. Further, since the first portion 50*b* has a small curvature factor it is capable of strongly receiving the pushing force from the second print medium, and the feeding roller 10 can easily be moved upward.

As shown in FIG. 7, the feeder 200 comprises a movement member coiled spring 51 that biases the second portion 50*c* of the movement member 50 downward with respect to the feeding arm 33.

Moreover, due to the movement member coiled spring 51, the movement member 50 can easily move the feeding roller 10 upward by functioning as a lever.

Figure 8A:
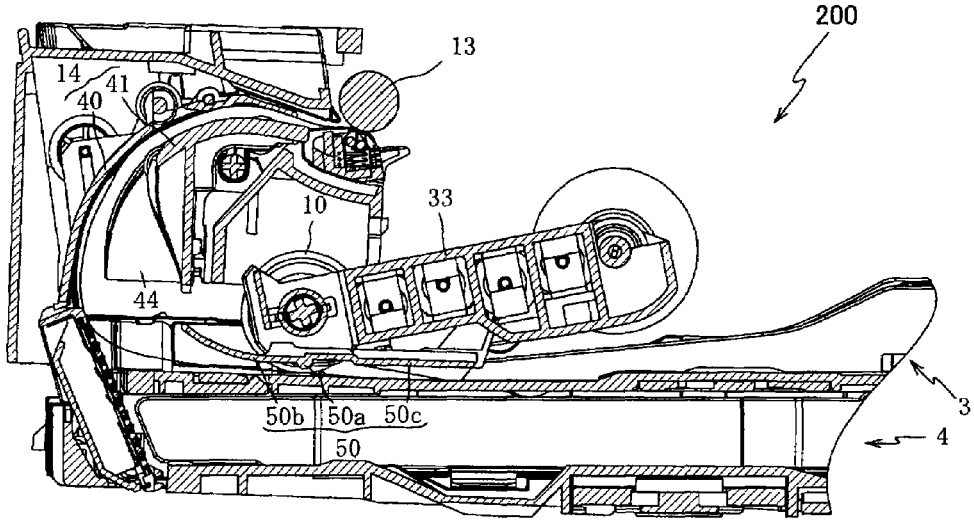
FIG. 8A shows a state before a second print medium reaches a transporting roller.
Figure 8B:
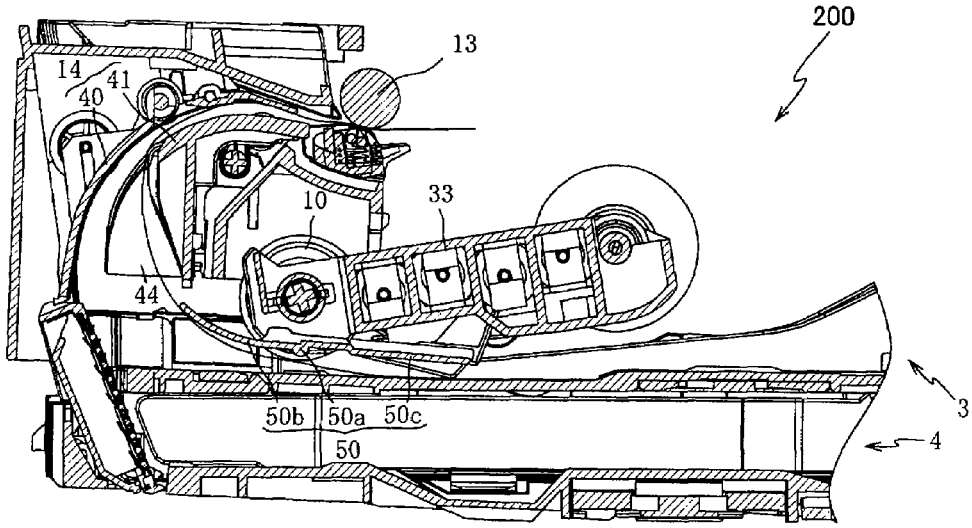
FIG. 8B shows a state after the second print medium reaches the transporting roller.

Next, a case will be described in detail, with reference to FIG. 8, where the feeder 200 configured as described above transports the second print medium housed in the top feeder tray 4. FIGS. 8A and 8B show how the second print medium is transported by the feeder 200. FIG. 8A shows a state before the second print medium reaches the transporting roller 13. FIG. 8B shows a state after the second print medium has reached the transporting roller 13.

First, the top feeder tray 4 is set at a predetermined position (a position at which the second print medium can be transported, a position making contact with the oblique separating wall 17). Next, the feeding roller 10 makes contact with the uppermost sheet of the second print medium that is housed in a stacked state in the top feeder tray 4, the feeding roller 10 rotates, whereupon the second print medium is fed toward the transporting path. Thereupon, the second print medium is transported in a U-shape along the oblique separating wall 17 and the outer transporting guide 40, and is gripped by the transporting roller 13 (see FIG. 8A).

When the second print medium is gripped by the transporting roller 13, the second print medium is transported by both the feeding roller 10 and the transporting roller 13 along the transporting path such that the curvature factor thereof is gradually reduced and the second print medium is pulled from the outer transporting guide 40 side toward the inner transporting guide 41 side. A portion of the second print medium is transported within the concave portion 44 formed in the inner transporting guide 41 (see FIG. 8B).

Thus, when the second print medium, housed in the top feeder tray 4, is transported by the feeding roller 10 and the transporting roller 13, this second print medium is transported while passing through the concave portion 44, and consequently the curvature factor of the second print medium housed in the top feeder tray 4 does not become greater than necessary and it is possible to prevent an increase in transport resistance. It is thus possible to transport the print media housed in the top and lower feeder trays 3 and 4 stably and by means of a simple configuration.

Furthermore, when the second print medium is transported by the feeding roller 10 and the transporting roller 13 such that the curvature factor thereof is gradually reduced, the feeding roller 10 is moved upward via the feeding arm 33 by means of the operation of the movement member 50. As a result, the pushing force that the feeding roller 10 exerts on the uppermost sheet of the second print medium is gradually reduced, and consequently the transporting load of the transporting roller 13 can be reduced gradually. The feeder 200 is consequently able to transport the second print medium stably.

The present invention has been described using the above embodiment. However, the present invention is not restricted to the above embodiment; it can also be embodied in various ways within a range that does not deviate from the substance thereof.

For example, in the above embodiment, the axis bisecting the concave portion 44 in the widthwise direction thereof is identical to the axis bisecting the inner transporting guide 41 in the widthwise direction thereof. However, the two bisecting axes do not need to be identical. The concave portion 44 may merely form a concave within the inner transporting guide 41 without detrimentally affecting the function of the invention.

Furthermore, in the above embodiment, an example was described wherein the feeding roller 10 and the transporting roller 13 were utilized for transporting the print medium. However, the technique of reducing the curvature factor of the transporting path by means of the concave portion 44 can also be utilized in a case where a device is utilized without the feeding roller 10 and the transporting roller 13.

What is claimed is:

1. A feeder for transporting a print medium from a tray along a U-shaped transporting path, comprising:

a first tray comprising a first housing portion configured to house a first print medium;

a second tray comprising a second housing portion configured to house a second print medium, the second tray being located between the first tray and a downstream end of the U-shaped transporting path;

a transporting guide configured to guide each of the first print medium and the second print medium in a transportation direction from each of the first tray and the second tray, respectively, to the downstream end of the U-shaped transporting path; and a feeding device configured to selectively feed the first print medium and the second print medium toward the U-shaped transporting path, wherein the transporting guide comprises an outer transporting guide and an inner transporting guide, the U-shaped transporting path is formed between the outer transporting guide and the inner transporting guide, the outer transporting guide extends from a position adjacent to one end of the first tray, the inner transporting guide extends from a position adjacent to one end of the second tray, the inner transporting guide comprises a concave portion facing the outer transporting guide, and the concave portion has a length which extends from an upstream end to a predetermined position of the inner transporting guide along the transportation direction, and the concave portion has a width which is smaller than a width of the inner transporting guide, the width of the concave portion is greater than or equal to a width of the second housing portion, and a widthwise direction of each of the inner transporting guide, the first housing portion, and the second housing portion is orthogonal to the transportation direction.

2. The feeder according to claim 1, wherein the inner transporting guide comprises a first surface, a second surface, a first side surface, and a second side surface, the first surface faces the outer transporting guide, the second surface is located between the first side surface and the second side surface, the second surface faces the outer transporting guide, the first side surface and the second side surface face one another, and the second surface, the first side surface and the second side surface form the concave portion.

3. The feeder according to claim 2, wherein a distance between the outer transporting guide and the first surface of the inner transporting guide is substantially constant along the transportation direction.

4. The feeder according to claim 1, wherein the feeding device comprises a feeding roller, and the feeding roller is configured to selectively make contact with one of the first print medium and the second print medium, and to selectively feed the contacted print medium toward the U-shaped transporting path.

5. The feeder according to claim 1, further comprising:

a transporting roller located at a position adjacent to the downstream end of the U-shaped transporting path, wherein the transporting roller and the feeding device have a positional relationship that allows the transporting roller and the feeding device to simultaneously make contact with the second print medium.

6. The feeder according to claim 5, further comprising a controller that controls the transporting roller and the feeding device such that a tension is generated in the second print medium when the transporting roller and the feeding device simultaneously make contact with the second print medium.

7. The feeder according to claim 1, further comprising:

a transporting roller located at a position adjacent to the downstream end of the U-shaped transporting path, and a controller, wherein feeding device comprises a feeding roller, the feeding roller is configured to selectively make contact with one of the first print medium and the second print medium, and to selectively feed the contacted print medium toward the U-shaped transporting path, a distance between the feeding roller and the transporting roller along the transportation direction is shorter than a length of the selected print medium, the controller controls the transporting roller and the feeding roller such that a tension is generated in the selected print medium when the transporting roller and the feeding roller simultaneously make contact with the selected print medium.

8. The feeder according to claim 1, wherein in the width direction of the inner transporting guide, the center of the inner transporting guide is substantially aligned with the center of the concave portion.

9. The feeder according to claim 1, wherein the predetermined position is located between the upstream end and a downstream end of the inner transporting guide.

10. The feeder according to claim 9, further comprising:

a roller located at the predetermined position, the roller being capable of rotating.

11. The feeder according to claim 1, wherein a depth of the concave portion gradually decreases along the transportation direction.

12. The feeder according to claim 1, further comprising:

a plurality of ribs disposed on a bottom surface of the concave portion, each rib extending along the transportation direction.

13. The feeder according to claim 12, wherein a height of each rib gradually increases along the transportation direction.

14. The feeder according to claim 13, wherein each rib does not extend beyond the concave portion.

15. A printer, comprising:

the feeder according to claim 1; and a printing device that prints an image on the print medium transported by the feeder.

16. The feeder according to claim 1, wherein the first tray comprises a first housing member that sets the first housing portion, the second tray comprises a second housing member that sets the second housing portion, and the width of the concave portion is greater than or equal to a maximum width of the second housing portion.

17. The feeder according to claim 16, wherein the width of the concave portion is smaller than a maximum width of the first housing portion.

18. A feeder comprising:

a tray comprising a first housing portion configured to house a first print medium and a second housing portion configured to house a second print medium, wherein a width of the first housing portion is greater than a width of the second housing portion; and a transporting guide comprising an outer transporting guide and an inner transporting guide that define a curved path therebetween, the transporting guide configured to guide each of the first print medium and the second print medium along the curved path in a transportation direction which is orthogonal to the width of the first housing portion and the width of the second housing portion, wherein the inner transporting guide comprises a first region and a second region that are opposed to the outer transporting guide and are arranged in a widthwise direction of the inner transporting guide, the widthwise direction of the inner transporting guide being orthogonal to the transportation direction, the first region comprises a plurality of first ribs projecting toward the outer transporting guide and arranged at intervals in the widthwise direction of the inner transporting guide, the second region comprises a plurality of second ribs projecting toward the outer transporting guide and arranged at intervals in the widthwise direction of the inner transporting guide, distances between the outer transporting guide and the plurality of second ribs are greater than distances between the outer transporting guide and the plurality of first ribs, and a width of the second region in the widthwise direction is greater than or equal to the width of the second housing portion.

19. The feeder according to claim 18, wherein the width of the second region in the widthwise direction is smaller than the width of the first housing portion.

20. The feeder according to claim 18, wherein the second region extends in the transporting direction from an upstream end of the inner transporting guide to a position between the upstream end and a downstream end of the inner transporting guide.

21. The feeder according to claim 18, wherein projecting ends of the plurality of first ribs define a first surface that guides the first print medium, projecting ends of the plurality of second ribs define a second surface that guides the second print medium, and the second surface is shifted inwardly away from the outer transporting guide with respect to the first surface in a radius direction of the curved path.

22. The feeder according to claim 18, wherein the first region comprises a first base portion from which the plurality of first ribs project, the second region comprises a second base portion from which the plurality of second ribs project, and the second base portion is shifted inwardly away from the outer transporting guide with respect to the first base portion in a radius direction of the curved path.

* * * * *